US011692152B2

(12) United States Patent
Depoot et al.

(10) Patent No.: US 11,692,152 B2
(45) Date of Patent: Jul. 4, 2023

(54) WATER-SOLUBLE UNIT DOSE ARTICLE

(71) Applicant: The Procter & Gamble Company, Cincinnati, OH (US)

(72) Inventors: Karel Jozef Maria Depoot, Anzegem-Vichte (BE); Hilde Francoise Louise Andriessen, Mol (BE); Robby Renilde Francois Keuleers, Lippelo (BE); Bart Andre Verbessem, Putte (BE)

(73) Assignee: The Procter & Gamble Company, Cincinnati, OH (US)

( * ) Notice: Subject to any disclaimer, the term of this patent is extended or adjusted under 35 U.S.C. 154(b) by 315 days.

(21) Appl. No.: 16/565,536

(22) Filed: Sep. 10, 2019

(65) Prior Publication Data

US 2020/0080026 A1 Mar. 12, 2020

(30) Foreign Application Priority Data

Sep. 11, 2018 (EP) ..... 18193763
Jul. 9, 2019 (EP) ..... 19185166

(51) Int. Cl.

| | |
|---|---|
| ***C11D 1/00*** | (2006.01) |
| ***C11D 1/29*** | (2006.01) |
| ***C11D 1/22*** | (2006.01) |
| ***C11D 3/37*** | (2006.01) |
| ***C11D 17/04*** | (2006.01) |

(52) U.S. Cl.

CPC ..... *C11D 1/29* (2013.01); *C11D 1/22* (2013.01); *C11D 3/3753* (2013.01); *C11D 17/043* (2013.01)

(58) Field of Classification Search

CPC ..... C11D 1/29; C11D 17/043
See application file for complete search history.

(56) References Cited

U.S. PATENT DOCUMENTS

| | | | | |
|---|---|---|---|---|
| 4,265,782 | A | 5/1981 | Armstrong | |
| 5,849,960 | A * | 12/1998 | Singleton | C07C 43/11 568/909 |
| 6,881,359 | B2 | 4/2005 | Leeners | |
| 10,047,321 | B2 * | 8/2018 | Meier | C11D 1/831 |
| 10,323,220 | B2 | 6/2019 | Somerville Roberts | |
| 2014/0073541 | A1 | 3/2014 | Ravikiran | |
| 2015/0105313 | A1 * | 4/2015 | Meier | C11D 17/043 510/406 |
| 2015/0184115 | A1 * | 7/2015 | Meier | C11D 1/83 510/406 |
| 2016/0068742 | A1 | 3/2016 | Solastiouk | |
| 2016/0340625 | A1 * | 11/2016 | Scheibel | C11D 1/146 |
| 2017/0369816 | A1 * | 12/2017 | Holland | C11D 1/75 |
| 2018/0023043 | A1 | 1/2018 | Lant | |
| 2018/0037855 | A1 | 2/2018 | Somerville Roberts | |

FOREIGN PATENT DOCUMENTS

| | | | | |
|---|---|---|---|---|
| EP | 3124585 | A1 * | 2/2017 | C11D 1/14 |
| WO | 9116409 | A1 | 10/1991 | |

OTHER PUBLICATIONS

EP Search Report for appl. No. 18193763.2-1105, dated Feb. 25, 2019 8 pages.

Extended European Search Report and Search Opinion, Application Ser. No. 19185166.6; dated Jan. 15, 2020; 8 pages.

* cited by examiner

*Primary Examiner* — Necholus Ogden, Jr.

(74) *Attorney, Agent, or Firm* — Andrew J. Mueller

(57) ABSTRACT

A water-soluble unit dose article containing an alkyl sulphate. A use thereof.

10 Claims, 3 Drawing Sheets

WATER-SOLUBLE UNIT DOSE ARTICLE

FIELD OF THE INVENTION

The present disclosure relates to a water-soluble unit dose article containing an alkyl sulphate, and uses thereof.

BACKGROUND OF THE INVENTION

Water-soluble unit dose articles are liked by consumers as they offer convenience and ease to the laundry process. Without wishing to be bound by theory, the water-soluble unit dose article comprises a water-soluble film and a unitized dose of a laundry treatment composition which may be with one or more compartments within the unit dose article.

Consumers expect such unit dose articles to exhibit, amongst other things, excellent grease cleaning ability and excellent dissolution in the wash. Without wishing to be bound by theory, consumers do not want to have re-wash' fabrics in order to remove greasy stains. Additionally, if the unit dose article does not effectively dissolve in the wash then residues can be left on fabrics. These are unsightly and consumers feel the need to re-wash the fabrics which is time consuming and costly to the consumer.

Therefore, there is a need in the art for a water-soluble unit dose article that exhibits excellent grease cleaning and dissolution as compared to known water-soluble unit dose articles.

It was surprisingly found that a water-soluble unit dose article comprising a first anionic surfactant wherein the first anionic surfactant is an alkyl sulphate anionic surfactant comprising at least one alkoxylated alkyl sulphate or a mixture of at least one alkoxylated alkyl sulphate and at least one non-alkoxylated alkyl sulphate, and wherein the first anionic surfactant comprises a mixture of branched and linear alkyl chains wherein the alkyl chains having a weight average degree of branching of at least 20%, overcame the above-mentioned problem.

Without wishing to be bound by theory, it was surprisingly found that a water-soluble unit dose article comprising a first anionic surfactant wherein the first anionic surfactant is an alkyl sulphate anionic surfactant comprising at least one alkoxylated alkyl sulphate or a mixture of at least one alkoxylated alkyl sulphate and at least one non-alkoxylated alkyl sulphate, and wherein the first anionic surfactant comprises a mixture of branched and linear alkyl chains and wherein the alkyl chains having a weight average degree of branching of at least 20%, exhibited improved grease cleaning as compared to a water-soluble unit dose article comprising an alkyl sulphate anionic surfactant, especially an alkyl sulphate anionic surfactant comprising at least one alkoxylated alkyl sulphate or a mixture of at least one alkoxylated alkyl sulphate and at least one non-alkoxylated alkyl sulphate, having a lower weight average degree of branching. This is surprising as the skilled person would predict that linear alkyl sulphate anionic surfactants would provide better grease cleaning than branched material equivalents as linear materials pack better at the soil-wash solution interface. In addition, surprisingly, the water-soluble unit dose article according to the invention exhibited improved dissolution as compared to a water-soluble unit dose article comprising alkyl sulphate anionic surfactants having a lower weight average degree of branching. This is again surprising as a skilled person would expect an opposite grease cleaning versus dissolution performance trend, i.e. a strong surfactant packing efficiency enabling strong grease cleaning would also be expected to inhibit surfactant dissolution, the latter requiring breaking of the surfactant aggregates into individual or lower aggregate surfactant structures.

SUMMARY OF THE INVENTION

The present disclosure relates to a water-soluble unit dose article comprising a water-soluble film and a liquid laundry detergent composition, wherein the liquid laundry detergent composition comprises a first anionic surfactant wherein the first anionic surfactant is an alkyl sulphate anionic surfactant comprising at least one alkoxylated alkyl sulphate or a mixture of at least one alkoxylated alkyl sulphate and at least one non-alkoxylated alkyl sulphate; and wherein the first anionic surfactant comprises a mixture of branched and linear alkyl chains wherein the alkyl chains have a weight average degree of branching of at least 20% wherein the liquid laundry detergent composition comprises between 5% and 35% by weight of the liquid laundry detergent composition of the first anionic surfactant.

The present disclosure relates to the use of the first anionic surfactant as according to the present invention in a water-soluble unit dose article according to the present invention to provide optimised grease cleaning on fabrics and unit dose article dissolution in water.

DETAILED DESCRIPTION OF THE INVENTION

Water-Soluble Unit Dose Article

Figure 1:
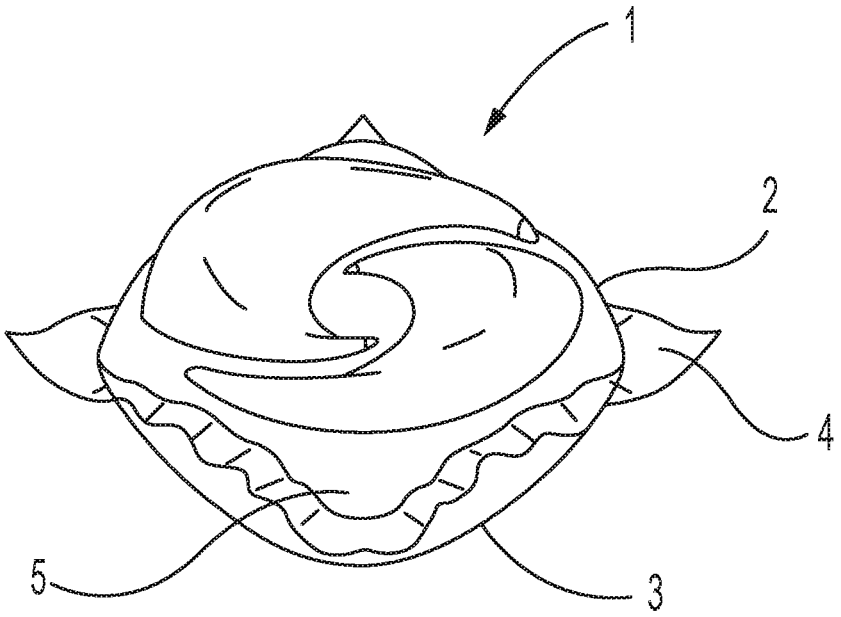
FIG. 1 is a water-soluble unit dose article according to the present invention.

The present disclosure relates to a water-soluble unit dose article comprising a water-soluble film and a liquid laundry detergent composition. The water-soluble film is described in more detail below. The liquid laundry detergent composition is described in more detail below.

The water-soluble unit dose article comprises at least one water-soluble film shaped such that the unit-dose article comprises at least one internal compartment surrounded by the water-soluble film. The at least one compartment comprises the liquid laundry detergent composition. The water-soluble film is sealed such that the liquid laundry detergent composition does not leak out of the compartment during storage. However, upon addition of the water-soluble unit dose article to water, the water-soluble film dissolves and releases the contents of the internal compartment into the wash liquor.

The compartment should be understood as meaning a closed internal space within the unit dose article, which holds the liquid laundry detergent composition. Preferably, the unit dose article comprises a water-soluble film. The unit dose article is manufactured such that the water-soluble film completely surrounds the liquid laundry detergent composition and in doing so defines the compartment in which the liquid laundry detergent composition resides. The unit dose article may comprise two films. A first film may be shaped to comprise an open compartment into which the liquid laundry detergent composition is added. A second film is then laid over the first film in such an orientation as to close the opening of the compartment. The first and second films are then sealed together along a seal region. The film is described in more detail below.

The unit dose article may comprise more than one compartment, even at least two compartments, or even at least three compartments. The compartments may be arranged in superposed orientation, i.e. one positioned on top of the other. Alternatively, the compartments may be positioned in a side-by-side orientation, i.e. one orientated next to the other. The compartments may even be orientated in a 'tyre and rim' arrangement, i.e. a first compartment is positioned next to a second compartment, but the first compartment at least partially surrounds the second compartment but does not completely enclose the second compartment. Alternatively, one compartment may be completely enclosed within another compartment.

Wherein the unit dose article comprises at least two compartments, one of the compartments may be smaller than the other compartment. Wherein the unit dose article comprises at least three compartments, two of the compartments may be smaller than the third compartment, and preferably the smaller compartments are superposed on the larger compartment. The superposed compartments preferably are orientated side-by-side.

In a multi-compartment orientation, the liquid laundry detergent composition according to the present invention may be comprised in at least one of the compartments. It may for example be comprised in just one compartment, or may be comprised in two compartments, or even in three compartments.

Each compartment may comprise the same or different compositions. The different compositions could all be in the same form, or they may be in different forms.

Water-Soluble Film

The film of the present invention is soluble or dispersible in water. The water-soluble film preferably has a thickness of from 20 to 150 micron, preferably 35 to 125 micron, even more preferably 50 to 110 micron, most preferably about 76 micron.

Preferably, the film has a water-solubility of at least 50%, preferably at least 75% or even at least 95%, as measured by the method set out here after using a glass-filter with a maximum pore size of 20 microns:

5 grams±0.1 gram of film material is added in a pre-weighed 3 L beaker and 2 L±5 ml of distilled water is added. This is stirred vigorously on a magnetic stirrer, Labline model No. 1250 or equivalent and 5 cm magnetic stirrer, set at 600 rpm, for 30 minutes at 30° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Preferably, the water-soluble film comprises polyvinyl alcohol polymer or copolymer, preferably a blend of polyvinylalcohol polymers and/or polyvinylalcohol copolymers, preferably selected from sulphonated and carboxylated anionic polyvinylalcohol copolymers especially carboxylated anionic polyvinylalcohol copolymers, most preferably a blend of a polyvinylalcohol homopolymer and a carboxylated anionic polyvinylalcohol copolymer.

Preferred films exhibit good dissolution in cold water, meaning unheated distilled water. Preferably such films exhibit good dissolution at temperatures of 24° C., even more preferably at 10° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol under the trade references M8630, M8900, M8779, M8310.

The film may be opaque, transparent or translucent. The film may comprise a printed area.

The area of print may be achieved using standard techniques, such as flexographic printing or inkjet printing.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

Laundry Detergent Composition

The water-soluble unit dose article comprises a liquid laundry detergent composition. The term 'liquid laundry detergent composition' refers to any laundry detergent composition comprising a liquid capable of wetting and treating a fabric, and includes, but is not limited to, liquids, gels, pastes, dispersions and the like. The liquid composition can include solids or gases in suitably subdivided form, but the liquid composition excludes forms which are non-fluid overall, such as tablets or granules.

The liquid laundry detergent composition can be used in a fabric hand wash operation or may be used in an automatic machine fabric wash operation.

The liquid laundry detergent composition comprises a first anionic surfactant. The first anionic surfactant is described in more detail below.

The liquid laundry detergent composition comprises between 5% and 35%, preferably between 10% and 30% by weight of the liquid laundry detergent composition of the first anionic surfactant.

Preferably, the liquid laundry detergent composition comprises a second anionic surfactant, wherein the second anionic surfactant is a linear alkyl benzene sulphonate. More preferably the weight ratio of the second anionic surfactant to the first anionic surfactant is from 1:10 to 10:1, preferably from 6:1 to 1:6, more preferably from 4:1 to 1:4, even more preferably from 3:1 to 1:1. Alternatively, the weight ratio of the second anionic surfactant to the first anionic surfactant is from 1:2 to 1:4.

Preferably, the liquid laundry detergent composition comprises between 5% and 60%, more preferably between 20% and 55% by weight of the liquid laundry detergent composition of non-soap surfactant. More preferably the liquid laundry detergent composition comprises between 5% and 60%, preferably between 15% and 55%, more preferably between 25% and 50%, most preferably between 30% and 45% by weight of the liquid laundry detergent composition of non-soap anionic surfactant. For the avoidance of any doubt, the first anionic surfactant and the second anionic surfactant are non-soap anionic surfactants.

Preferably, the liquid laundry detergent composition comprises a non-ionic surfactant, preferably wherein the non-ionic surfactant is selected from natural oil derived alcohol alkoxylate, Ziegler-synthesised alcohol alkoxylate, an oxo-synthesised alcohol alkoxylate, Guerbet alcohol alkoxylates, alkyl phenol alcohol alkoxylates or a mixture thereof. Preferably, the natural oil is selected from palm kernel oil, coconut oil or a mixture thereof. More preferably the liquid laundry detergent composition comprises between 0% and 15%, preferably between 0.01% and 12%, more preferably between 0.1% and 10%, most preferably between 0.15% and 7% by weight of the liquid laundry detergent composition of a non-ionic surfactant. For the avoidance of any doubt, a non-ionic surfactant is a non-soap surfactant.

The liquid detergent composition may comprise between 1.5% and 20%, more preferably between 2% and 15%, even more preferably between 3% and 10%, most preferably between 4% and 8% by weight of the liquid laundry detergent composition of a fatty acid salt. For the avoidance of any doubt, fatty acid salt is defined as a soap.

The liquid laundry detergent composition preferably comprises a non-aqueous solvent selected from 1,2-propanediol, dipropylene glycol, tripropyleneglycol, glycerol, sorbitol, polypropylene glycol or a mixture thereof, preferably wherein the polypropylene glycol has a molecular weight of 400. Preferably, the liquid laundry detergent composition comprises between 10% and 40%, preferably between 15% and 30% by weight of the liquid laundry detergent composition of the non-aqueous solvent.

Preferably, the liquid laundry detergent composition comprises between 0.5% and 15%, preferably between 5% and 13% by weight of the liquid laundry detergent composition of water.

The liquid laundry detergent composition may comprise an ingredient selected from the list comprising cationic polymers, polyester terephthalates, amphiphilic graft copolymers, carboxymethylcellulose, enzymes, perfumes, encapsulated perfumes, bleach or a mixture thereof.

The liquid laundry detergent composition may comprise an adjunct ingredient, wherein the adjunct ingredient is selected from ethanol, ethyleneglycol, polyethyleneglycol, hueing dyes, aesthetic dyes, builders preferably citric acid, chelants, dispersants, dye transfer inhibitor polymers, fluorescent whitening agent, opacifier, antifoam, preservative, anti-oxidants, or a mixture thereof. Preferably, the chelant is selected from aminocarboxylate chelants, aminophosphonate chelants, or a mixture thereof.

Preferably, the liquid laundry detergent composition has a pH between 6 and 10, more preferably between 6.5 and 8.9, most preferably between 7 and 8, wherein the pH of the liquid laundry detergent composition is measured as a 10% dilution in demineralized water at 20° C.

The liquid laundry detergent composition may be Newtonian or non-Newtonian. Preferably, the liquid laundry detergent composition is non-Newtonian. Without wishing to be bound by theory, a non-Newtonian liquid has properties that differ from those of a Newtonian liquid, more specifically, the viscosity of non-Newtonian liquids is dependent on shear rate, while a Newtonian liquid has a constant viscosity independent of the applied shear rate. The decreased viscosity upon shear application for non-Newtonian liquids is thought to further facilitate liquid detergent dissolution.

The liquid laundry detergent composition described herein can have any suitable viscosity depending on factors such as formulated ingredients and purpose of the composition. When Newtonian the composition may have a viscosity value, at a shear rate of 20 $s^{-1}$ and a temperature of 20° C., of 100 to 3,000 cP, alternatively 200 to 2,000 cP, alternatively 300 to 1,000 cP, following the method described herein. When non-Newtonian, the composition may have a high shear viscosity value, at a shear rate of 20 $s^{-1}$ and a temperature of 20° C., of 100 to 3,000 cP, alternatively 300 to 2,000 cP, alternatively 500 to 1,000 cP, and a low shear viscosity value, at a shear rate of 1 $s^{-1}$ and a temperature of 20° C., of 500 to 100,000 cP, alternatively 1000 to 10,000 cP, alternatively 1,300 to 5,000 cP, following the method described herein. Methods to measure viscosity are known in the art. According to the present disclosure, viscosity measurements are carried out using a rotational rheometer e.g. TA instruments AR550. The instrument includes a 40 mm 2° or 1° cone fixture with a gap of around 50-60μιη for isotropic liquids, or a 40 mm flat steel plate with a gap of 1000μιη for particles containing liquids. The measurement is carried out using a flow procedure that contains a conditioning step, a peak hold and a continuous ramp step. The conditioning step involves the setting of the measurement temperature at 20° C., a pre-shear of 10 seconds at a shear rate of 10 s1, and an equilibration of 60 seconds at the selected temperature. The peak hold involves applying a shear rate of 0.05 s1 at 20° C. for 3 min with sampling every 10 s. The continuous ramp step is performed at a shear rate from 0.1 to 1200 s1 for 3 min at 20° C. to obtain the full flow profile.

First Anionic Surfactant

The liquid laundry detergent composition comprises a first anionic surfactant. The first anionic surfactant is an alkyl sulphate anionic surfactant comprising at least one alkoxylated alkyl sulphate or a mixture of at least one alkoxylated alkyl sulphate and at least one non-alkoxylated alkyl sulphate. The first anionic surfactant comprises a mixture of branched and linear alkyl chains wherein the alkyl chains have a weight average degree of branching of at least 20%.

Without wishing to be bound by theory, the first anionic surfactant comprises a mixture of alkyl sulphates. Some of the alkyl sulphates may be non-alkoxylated, whilst the remainder will be alkoxylated, preferably ethoxylated. A proportion of the alkyl sulphates (both alkoxylated and non-alkoxylated) may be linear whilst the remainder will be branched. Additionally, the first anionic surfactant may be composed of differently sourced alkoxylated alkyl sulphate, or even a mixture of one or more alkoxylated alkyl sulphates with one or more non-alkoxylated alkyl sulphates, i.e. alkyl sulphates and/or alkoxylated alkyl sulphates made from different starting alcohols. Without wishing to be bound theory, the alkyl sulphate, alkoxylated alkyl sulphate or mixture thereof is manufactured from a starting alcohol (see below).

The weight average degree of branching is the weight average % of branching and it is defined according to the following formula:

$$\text{Weight average of branching (\%)}=[(x1*\text{wt \% branched alcohol1 in alcohol1}+x2*\text{wt \% branched alcohol2 in alcohol2}+\ldots)/(x1+x2+\ldots)]*100$$

wherein x1, x2, are the weight in grams of each alcohol in the total alcohol mixture of the alcohols which were used as starting material for the first anionic surfactant, in other words, including all differently sourced alkyl sulphate and alkoxylated alkyl sulphate starting alcohol materials. For the avoidance of any doubt, for alkoxylated alkyl sulphates, the non-alkoxylated alcohol is to be considered as starting material in above equation. In the weight average branching degree calculation the weight of starting alcohols for the first anionic surfactant not having branched groups should also be included.

Preferably, the weight average degree of branching is between 25% and 95%, preferably between 30% and 80%, more preferably between 35% and 70%, even more preferably between 40% and 60%.

Preferably, the first anionic surfactant comprises a distribution of alkyl chain lengths with an average carbon number for said alkyl chains of between 10 and 18 carbons, preferably between 11 and 16 carbons, more preferably between 12 and 15 carbons. Without wishing to be bound by theory, the first anionic surfactant comprises a distribution of different chain length alkyl sulphates. The average carbon number is a mol average carbon number, again calculated based on the starting alcohols used to produce the first anionic surfactant, again considering all the differently sourced alkyl sulphate and alkoxylated alkyl sulphate starting alcohol materials. Again, for the avoidance of any doubt, for alkoxylated alkyl sulphates, the non-alkoxylated alcohol is to be considered as starting material for the mol average carbon number calculation.

Preferably, the first anionic surfactant comprises a distribution of alkoxylate chains, preferably ethoxylate chains and wherein the mol average alkoxylate, preferably ethoxylate chain length is between 0.5 and 7, preferably between 1 and 5, more preferably between 2 and 4. The average alkoxylation degree is the mol average alkoxylation degree of all the components of the mixture (i.e., mol average alkoxylation degree) of the first anionic surfactant. In the mol average alkoxylation degree calculation the weight of alkyl sulphate anionic surfactant components not having alkoxylate groups should also be included.

$$\text{Mol average alkoxylation degree}=(x1*\text{alkoxylation degree of surfactant1}+x2*\text{alkoxylation degree of surfactant2}+\ldots)/(x1+x2+\ldots)$$

wherein x1, x2, . . . are the number of moles of each alkyl sulphate and alkyl alkoxy sulphate anionic surfactant of the mixture and alkoxylation degree is the number of alkoxy groups in each alkyl sulphate (e.g. zero) and alkyl alkoxy sulphate anionic surfactant material.

Those skilled in the art will be aware of known methods to make the first anionic surfactant. Without wishing to be bound by theory, the first anionic surfactant is manufactured from a naturally derived alcohol, a synthetically derived alcohol or a mixture thereof.

Preferably, the synthetic alcohol is made following the Ziegler process, OXO-process, modified OXO-process, the Fischer Tropsch process, Guerbet process or a mixture thereof.

Preferably, the naturally derived alcohol is derived from natural oils, preferably coconut oil, palm kernel oil or a mixture thereof.

The first anionic surfactant may be made by reacting an alcohol, or a blend of alcohols, with ethylene oxide to make an alcohol ethoxylate, then reacting said alcohol ethoxylate or blend of alcohol ethoxylates with $SO_3$ to make the ethoxylated alkyl sulphate, wherein the alcohol or blend of alcohols is a naturally derived alcohol, a synthetic alcohol or a mixture thereof. For alkylates the starting alcohol(s) is (are) reacted with alkylene oxide instead.

Alternatively, each or some of the alcohols can be individually ethoxylated/alkoxylated first and then blended afterwards as ethoxylated/alkoxylated alcohols prior to sulphation. The skilled person may mix at least one non-ethoxylated/alkoxylated alkyl with at least one alkyl ethoxylate and/or alkyl alkoxylate and then sulphate the blend together to achieve the right blend, i.e. to meet targeted average alkyl chain lengths, branching degree and ethoxylation/alkoxylation degree. This is typically done when targeting lower average ethoxylations/alkoxylations, i.e. between 0 and 2.

Alternatively, the skilled person may sulphate individual (non-)ethoxylated/alkoxylated alkyls and then blend the alkyl sulphates and/or alkyl ethoxy/alkoxy sulphates to achieve the desired blend, i.e. to meet targeted average alkyl chain lengths, branching degree and ethoxylation/alkoxylation degree.

Without wishing to be bound theory, through tight control of processing conditions and feedstock material compositions, both during alkoxylation especially ethoxylation and sulfation steps, the amount of 1,4-dioxane by-product within alkoxylated especially ethoxylated alkyl sulphates can be kept minimal. A further reduction of 1,4-dioxane by-product can be achieved by a consequent 1,4-dioxane stripping, distillation, evaporation, centrifugation, microwave irradiation, molecular sieving or catalytic or enzymatic degradation step. Processes to control 1,4-dioxane content within alkoxylated/ethoxylated alkyl sulphates have been described extensively in the art. Alternatively 1,4-dioxane level control within detergent formulations has also been described in the art through addition of 1,4-dioxane inhibitors to 1,4-dioxane comprising formulations, i.e. 5, 6-dihydro-3-(4-morpholinyl)-1-[4-(2-oxo-1-piperidinyl) phenyl]-2 (1H)-pyridone, 3 a-hydroxy-7-oxo-mixture of cholanic acid, 3-(N-methyl amino)-L-alanine, and mixtures thereof. Tight 1,4-dioxane control across the raw material and detergent making process enables product formulations with remaining 1,4-dioxane content of below 10 ppm, preferably below 5 ppm, even more preferably below 1 ppm. An aspect of the present invention is a unit dose article according to the present invention, wherein the first anionic surfactant has been post-treated to reduce its dioxane content post production.

Suitable examples of commercially available alkyl and alkyl alkoxy sulphates include, those based on Neodol alcohols ex the Shell company, Lial-Isalchem and Safol alcohols ex the Sasol company, Lutensol alcohols ex the BASF company, and natural alcohols ex The Procter & Gamble Chemicals company.

Process for Washing

A further aspect of the present invention is a process for washing fabrics comprising the steps of;

a. Combining a water-soluble unit dose article according to the present invention with sufficient water to dissolve the water-soluble film and dilute the laundry detergent composition by a factor of between 300 and 3000 fold, preferably between 300 and 800 fold to form a wash liquor;

b. Combining the wash liquor with at least one fabric to be washed.

Preferably the main wash liquor may comprise between 1 L and 64 L, preferably between 2 L and 32 L, more preferably between 3 L and 20 L of water.

Preferably, the wash liquor is at a temperature of between 5° C. and 90° C., preferably between 10° C. and 60° C., more preferably between 12° C. and 45° C., most preferably between 15° C. and 40° C.

Preferably, washing the fabrics in the wash liquor takes between 5 minutes and 50 minutes, preferably between 5 minutes and 40 minutes, more preferably between 5 minutes and 30 minutes, even more preferably between 5 minutes and 20 minutes, most preferably between 6 minutes and 18 minutes to complete.

Preferably, the wash liquor comprises between 1 kg and 20 kg, preferably between 3 kg and 15 kg, most preferably between 5 kg and 10 kg of fabrics.

The wash liquor may comprise water of any hardness preferably varying between 0 gpg to 40 gpg. A lower water hardness is termed soft water whereas a higher water hardness is termed hard water.

Use of the First Anionic Surfactant

The present disclosure also relates to the use of a first anionic surfactant according to the present invention in a water-soluble unit dose article according to the present invention to provide optimised grease cleaning on fabrics and unit dose article dissolution in water.

EXAMPLES

Example 1

FIG. 1 discloses a water-soluble unit dose article (1) according to the present disclosure. The water-soluble unit dose article (1) comprises a first water-soluble film (2) and a second water-soluble film (3) which are sealed together at a seal region (4). The laundry detergent composition (5) is comprised within the water-soluble soluble unit dose article (1).

Example 2

The grease cleaning and dissolution performance of two water soluble unit dose compositions comprising an ethoxylated alkyl sulphate surfactant with an average degree of branching according to the invention and two water soluble unit dose compositions comprising an ethoxylated alkyl sulphate surfactant with an average degree of branching outside the scope of the invention was assessed following the grease cleaning and dissolution test methods described herein.

Formulations

All formulations were trimmed to equal starting pH (e.g. 7.4) using MEA. Inventive Example 1 comprises an ethoxylated alkyl sulphate according to the invention with a weight average degree of branching of 55%, an average alkyl carbon number between 12 and 13, and a mol average degree of ethoxylation of 3. Inventive Example 2 comprises an ethoxylated alkyl sulphate according to the invention with a weight average degree of branching of 55%, an average alkyl carbon number between 14 and 15, and a mol average degree of ethoxylation of 3. Comparative Example 1 comprises an ethoxylated alkyl sulphate outside the scope of the invention with a weight average degree of branching of 0%. Comparative Example 2 also comprises an ethoxylated alkyl sulphate outside the scope of the invention with a weight average degree of branching of solely 18%.

27.61 g of below test formulations has been used for assessing their relative grease cleaning performance, following the test method described herein.

All test formulations have also been enclosed in a water soluble PVA film, supplied by the Monosol company, to obtain the water soluble unit dose product (27.61 g) for assessing water soluble unit dose dissolution, following the test method described herein. For unit dose dissolution testing a 3 compartment water soluble unit dose product has been made following the Aria 3-in-1 Pods design, as commercially available in the UK in January 2018. Test formulations below were enclosed in the largest bottom compartment, while Comparative Example 1 formulation was added in the small top compartments. As a result, while the weight average degree of branching of the large bottom compartment juice was as per tabulated below, the weight average degree of branching of the entire water soluble unit dose article used for dissolution slightly dropped to 48%/48%/0%/16% for Inventive Example 1/Inventive Example 2/Comparative Example 1/Comparative Example 2 respectively.

| RM | Inventive Example 1 | Inventive Example 2 | Comparative Example 1 | Comparative Example 2 |
|---|---|---|---|---|
| C23 HAE3S | 14.7 | — | — | — |
| C45 HAE3S | — | 14.8 | — | — |
| C24 HAE3S | — | — | 14.8 | — |
| C25 HAE3S | — | — | — | 14.7 |
| Degree alkyl branching HAE3S | 55% | 55% | 0% | 18% |
| Alkyl source HAE3S | Lial 123-3 (Sasol OXO-process) | Lial 145-3 (Sasol OXO-process) | 12-14-3 ex P&G Chemicals (natural derived) | Neodol 25-3 (Shell OXO-process) |
| HLAS | 21.5 | 21.6 | 21.5 | 21.5 |
| Lutensol XL100 | 0.46 | 0.46 | 0.46 | 0.46 |
| NI (C24-7) | 3.8 | 3.8 | 3.8 | 3.8 |
| Citric Acid | 0.71 | 0.71 | 0.71 | 0.71 |
| Fatty Acid | 6.0 | 6.0 | 6.0 | 6.0 |
| DiPropylenGlycol | 3.8 | 3.8 | 3.8 | 3.8 |
| Glycerine | 3.8 | 3.8 | 3.8 | 3.8 |
| Propanediol | 12.3 | 12.3 | 12.3 | 12.3 |
| Water | 10.7 | 10.7 | 10.7 | 10.7 |
| HEDP | 2.3 | 2.3 | 2.3 | 2.3 |
| Ethoxylated polyethyleneimine (PEI600EO20)* | 3.2 | 3.2 | 3.2 | 3.2 |
| Amphiphilic graft copolymer** | 2.2 | 2.2 | 2.2 | 2.2 |
| Hydrogenated Castor Oil | 0.09 | 0.09 | 0.09 | 0.09 |
| Brightener 49 | 0.35 | 0.35 | 0.35 | 0.35 |
| Monoethanolamine (MEA) | 10.4 | 10.3 | 10.2 | 10.4 |
| Minors (incl. enzymes, anti-foam, anti-oxidant, preservatives, dyes, perfume, . . . ) | Balance to 100% | Balance to 100% | Balance to 100% | Balance to 100% |

*ethoxylated polyethyleneimine having an average degree of ethoxylation of 20 per EO chain and a polyethyleneimine backbone with MW of about 600

**polyethylene glycol graft polymer comprising a polyethylene glycol backbone (Pluriol E6000) and hydrophobic vinyl acetate side chains, comprising 40% by weight of the polymer system of a polyethylene glycol backbone polymer and 60% by weight of the polymer system of the grafted Test Methods Grease Cleaning:

Stained fabric swatches were prepared. Before the wash test, the test stains' visibility was measured using a colorimeter. Each stain was measured individually. These starting values were recorded to calculate the percentage removal of each individual test stain after the wash. These stained fabrics (2 replicates per stain per wash cycle) were washed (Miele washing machines, Normal/Regular Cycle at 40° C., 1.12 mmol·L water hardness) with 27.61 g of the respective test formulations in the presence of 3 kg of mixed cotton/polycotton ballast load. After the wash cycle the stained fabrics were tumble dried. This wash process was repeated 4 times, each time with fresh stains, resulting in a total of 8 replicates per stain. After drying the residual visibility of the stains on the fabrics were measured. The % Stain Removal Index of each stain were calculated using:

$$\% SRI = ((\text{Color fresh stain} - \text{Color washed stain}) / \text{Color Fresh stain}) * 100\%$$

Stain removal difference (Delta % SRI) of test formulations versus Comparative Example 1 reference has been calculated using:

$$\text{Delta } \% SRI = \% SRI(\text{test example}) - \% SRI \quad (\text{comparative example 1}).$$

Positive Delta % SRI values connote superior stain removal for the test versus the reference formulations.

Unit Dose Dissolution:

The unit dose dissolution test method aims at defining the dissolution time of unit dose pouches in water through measuring conductivity over time. Following production, pouches are stored for 2 weeks at 23° C., 50% rH to allow juice film equilibration.

Figure 2:
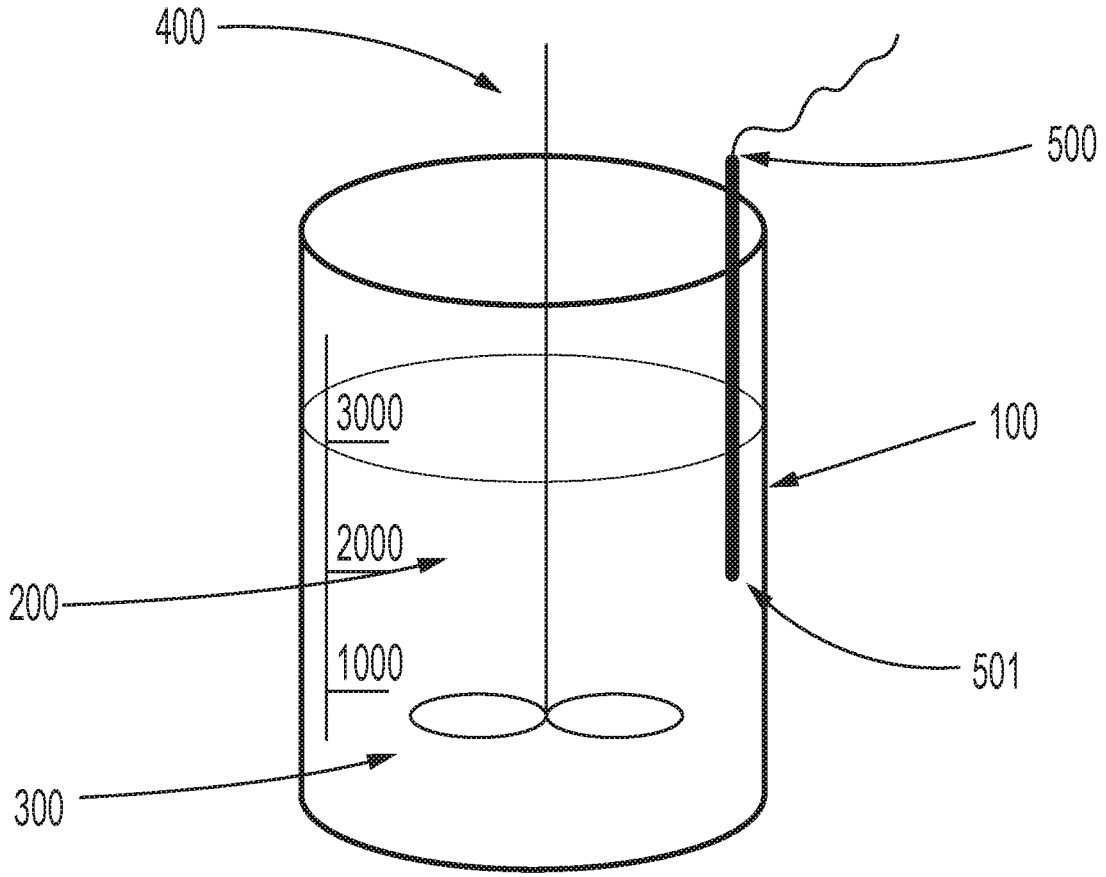
FIG. 2 details a visual set-up of the unit dose dissolution test.

A 5 L glass beaker (100) (diameter 17 cm) is filled with 3 L of demineralized water (200) between 19-21° C. and conductivity <5 μS·cm. A 4 blades impeller (300) (diameter 10 cm, model IKA R1345), connected to a mechanical stirrer (400) (type: IKA Eurostar power control) and set at a stirring speed of 70 rpm, is adjusted to the height that the top of the impeller blades is at the 1000 mL level of the beaker. A conductivity probe (type: Mettler Toledo Seven Excellence) and a temperature probe (500) are adjusted so that the height of the bottom of the probes (501) is at the 2000 mL level of the beaker. A visual of the test set up is shown in FIG. 2

Water soluble unit dose pouches are placed in metal pouch holders of sufficient size to hold the pouch at a fixed and reproducible position in the water solution, i.e. center point of the pouch at ⅓ of the height of the outer water column when stirring. The mesh size of the pouch holder is selected as such that it is not substantially impacting the water flow hence preventing impacting the dissolution experiment accordingly. Pouches are placed such that the pouch seal plane is in vertical position and as such substantially perpendicular to the water flow. If pouches of similar size are tested the same pouch holder is reused across the different test legs to minimize data variation.

Conductivity and temperature of the water solution are measured every 5 seconds during a total experiment time of 15 minutes, and measurements are started as soon as the pouch is immersed in the water solution and brought to its fixed position almost instantaneously. Individual conductivity measures are normalized to a % completion value per formula below.

$$\% \text{ Completion } (t) = \frac{Cond.(t) - \text{Min } Cond.}{\text{Max } Cond. - \text{Min } Cond.}$$

with Cond. (t) being the measured conductivity at a timepoint t, Min Cond. being the first conductivity measurement point, i.e. when immersing the water soluble pouch, and Max Cond. being the conductivity measured after 15 minutes.

All individual % completion values per film are consequently cumulated up to the targeted timepoint, and the average of 3 replicates are reported. The higher the cumulated % completion value at a given timepoint the faster the water soluble unit dose pouch dissolves.

Test Results:

Grease Cleaning:

Grease cleaning performance results, following the test method described herein, of the respective comparative and inventive examples are displayed in Table 1.

TABLE 1

Grease cleaning performance

| | Comparative Example 1 % SRI | Inventive Example 1 Delta % SRI | Inventive Example 2 Delta % SRI | Comparative Example 2 Delta % SRI |
|---|---|---|---|---|
| Dyed Bacon GSRTBGD001 | 56.8 | 3.1 | 3.5 | 3.3 |
| Burnt butter GSRTBB001 | 73.3 | 1.5 | 0.8 | 0.9 |
| Cooked Beef GSRTCBE001 | 52.9 | 5.2 | 8.4 | 5.7 |
| EQ021 AISE Makeup GSRTCGM001 | 59.7 | 8.0 | 8.9 | 9.4 |
| Average Delta | 0 | 4.5 | 5.4 | 4.8 |

Figure 3:
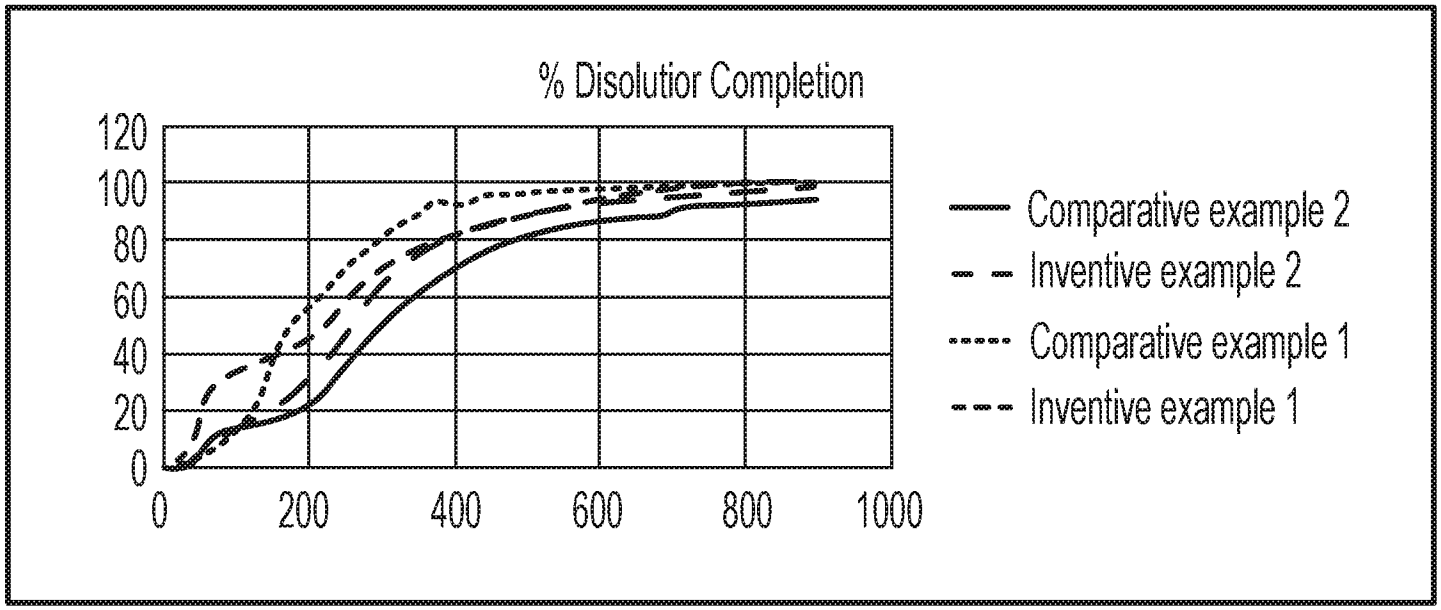
FIG. 3. discloses unit dose dissolution profiles.

Unit Dose Dissolution Profile:

The unit dose dissolution profile, following the test method described herein, of the respective comparative and inventive examples are displayed in FIG. 3. The cumulated % completion value between 0 and 270 seconds is calculated (sum of all measurements between 0 and 270 seconds) for the respective comparative and inventive examples and test results are displayed in table 2, as an indication of initial dissolution speed. A higher cumulated % completion value indicates a faster initial dissolution profile.

TABLE 2

Dissolution test results (Cumulated % completion between 0 and 270 seconds)

| | Comparative Example 1 | Inventive Example 1 | Inventive Example 2 | Comparative Example 2 |
|---|---|---|---|---|
| Cumulated % completion (0-270 s) | 1186% | 1728% | 1407% | 941% |

CONCLUSIONS

From the data tabulated above it can clearly be seen that Example formulations comprising an ethoxylated alkyl sulphate with a weight average degree of alkyl branching AES higher than 0% unexpectedly delivered improved grease cleaning. Indeed it is surprising that despite branching being known to inhibit strong packing at a soil-water interface, still superior cleaning performance is observed.

While a low degree of branching (Comparative Example 2) still delivered in line grease cleaning performance versus the inventive examples (contrary to 100% linear ethoxylated alkyl sulphate, i.e. Comparative Example 1), it demonstrated a far inferior onset of dissolution.

Formulating the correct level of branching (i.e. according to the invention) hence is key to provide the right balance between 1) securing solid grease cleaning performance AND 2) securing fast onset of unit dose pouch dissolution, especially key in view of the market trend towards shorter and colder wash cycles.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A water-soluble unit dose article comprising a water-soluble film and a liquid laundry detergent composition, wherein the liquid laundry detergent composition comprises between about 10% and about 30%, by weight of the liquid laundry detergent composition, of a first anionic surfactant, wherein the first anionic surfactant is an alkyl sulphate anionic surfactant comprising at least one alkoxylated alkyl sulphate or a mixture of at least one alkoxylated alkyl sulphate and at least one non-alkoxylated alkyl sulphate;

wherein the first anionic surfactant comprises a mixture of branched and linear alkyl chains wherein the alkyl chains have a weight average degree of branching of 55%;

wherein the first anionic surfactant comprises a distribution of alkyl chain lengths with an average carbon number for said alkyl chains of between about 10 and about 18 carbons, wherein the first anionic surfactant comprises a distribution of alkoxylate chains, and wherein the mol average alkoxylate chain length is between about 0.5 and about 7;

wherein the liquid laundry detergent composition further comprises a second anionic surfactant, wherein the second anionic surfactant is linear alkyl benzene sulphonate;

wherein the liquid laundry detergent composition further comprises between about 10% and about 40%, by weight of the liquid laundry detergent composition, comprising a material selected from the group consisting of 1,2 propane diol, dipropylene glycol, glycerol, tripropylene glycol, sorbitol, polypropylene glycol, and mixtures thereof;

wherein the liquid laundry detergent composition further comprises chelant;

wherein the liquid laundry detergent composition further comprises between about 0.5% and about 15%, by weight of the liquid laundry detergent composition, of water; wherein the first anionic surfactant is manufactured from a synthesized alcohol made following the Ziegler process, OXO-process, modified OXO-process, the Fischer Tropsch process, Guerbet process and mixtures thereof; and wherein the water-soluble film comprises polyvinyl alcohol polymer or copolymer.

2. The water-soluble unit dose article according to claim 1, wherein the first anionic surfactant comprises a distribution of alkyl chain lengths with an average carbon number for said alkyl chains of between about 12 and 15 carbons.

3. The water-soluble unit dose article according to claim 1, wherein the first anionic surfactant comprises a distribution of alkoxylate chains, and wherein the mol average alkoxylate chain length is between about 2 and 4.

4. The water-soluble unit dose article according to claim 1 wherein the weight ratio of the second anionic surfactant to the first anionic surfactant is from 1:10 to 10:1.

5. The water-soluble unit dose article according to claim 1 wherein the liquid laundry detergent composition comprises between about 5% and about 60%, by weight of the liquid laundry detergent composition of non-soap anionic surfactant.

6. The water-soluble unit dose article according to claim 1 wherein the liquid laundry detergent composition comprises a non-ionic surfactant, wherein the non-ionic surfactant is selected from a natural oil derived alcohol alkoxylate, a Ziegler-synthesised alcohol alkoxylate, an oxo-synthesised alcohol alkoxylate, Guerbet alcohol alkoxylates, alkyl phenol alcohol alkoxylates or a mixture thereof.

7. The water-soluble unit dose article according to claim 6 wherein the liquid laundry detergent composition comprises between about 0% and about 15%, by weight of the liquid laundry detergent composition of the non-ionic surfactant.

8. The water-soluble unit dose article according to claim 1 wherein the liquid detergent composition comprises between about 1.5% and about 20%, by weight of the liquid laundry detergent composition of a fatty acid salt.

9. The water-soluble unit dose article according to claim 1, wherein the water-soluble film comprises a blend of polyvinylalcohol polymers and/or polyvinylalcohol copolymers.

10. The water-soluble unit dose article according to claim 1 wherein the liquid laundry detergent composition has a pH between about 6 and about 10, wherein the pH of theliquid laundry detergent composition is measured as a about 10% dilution in demineralized water at about 20° C.

* * * * *